US012066274B2

(12) United States Patent
Miller

(10) Patent No.: US 12,066,274 B2
(45) Date of Patent: Aug. 20, 2024

(54) MODULAR LOCKING TARGET LOCK AND LOCKING TARGET SYSTEM

(71) Applicant: DOWNRANGE HEADQUARTERS, LLC, Springville, UT (US)

(72) Inventor: Jared Miller, Lehi, UT (US)

(73) Assignee: Downrange Headquarters LLC, Springville, UT (US)

( * ) Notice: Subject to any disclaimer, the term of this patent is extended or adjusted under 35 U.S.C. 154(b) by 57 days.

(21) Appl. No.: 17/839,096

(22) Filed: Jun. 13, 2022

(65) Prior Publication Data

US 2023/0013481 A1 Jan. 19, 2023

Related U.S. Application Data

(63) Continuation of application No. 16/016,239, filed on Jun. 22, 2018, now Pat. No. 11,359,891, which is a continuation of application No. 15/617,887, filed on Jun. 8, 2017, now Pat. No. 10,030,944.

(51) Int. Cl.
*F41J 1/10* (2006.01)
*F41J 1/01* (2006.01)

(52) U.S. Cl.
CPC .. *F41J 1/10* (2013.01); *F41J 1/01* (2013.01)

(58) Field of Classification Search
CPC ..... F41J 1/10; F41J 1/01
See application file for complete search history.

(56) References Cited

U.S. PATENT DOCUMENTS

| | | | |
|---|---|---|---|
| 2,782,846 | A | 2/1957 | Bussard |
| 2,783,493 | A | 3/1957 | Gussack |
| 4,470,603 | A | 9/1984 | Myers |
| 4,691,925 | A | 9/1987 | Scholem |
| 4,739,996 | A | 4/1988 | Vedder |
| 5,263,721 | A | 11/1993 | Lowrance |
| 6,776,418 | B1 | 8/2004 | Sovine |
| 7,175,181 | B1 | 2/2007 | Bateman |
| 8,684,361 | B2 | 4/2014 | Henson |
| 9,784,538 | B2 | 10/2017 | Sovine |
| 9,829,285 | B1 | 11/2017 | Kimblad |
| 10,030,944 | B1 | 7/2018 | Miller |
| 2005/0001381 | A1 | 1/2005 | Lambert |
| 2009/0174147 | A1 | 7/2009 | Saunders |
| 2011/0024985 | A1 | 2/2011 | Potterfield |

(Continued)

*Primary Examiner* — Jeffrey S Vanderveen
(74) *Attorney, Agent, or Firm* — Travis Banta; Loyal IP Law, PLLC

(57) ABSTRACT

This disclosure relates generally to a target system. The target system may include a locking plate having a first aperture and a second aperture. In one embodiment, the first aperture may be wider than the second aperture. The target system further includes a target face. The target face may be implemented with a target stem, a locking support, and a locking retainer. In one embodiment, the locking retainer may be wider than the second aperture. Similarly, a target is disclosed which includes a locking plate. The locking plate includes a pass-through portion and a locking portion. In certain embodiments, the locking portion may be wider than the pass-through portion. The target system further includes a target face. The target face may be implemented with an elongated portion, a locking support portion, and a locking retainer portion. In one embodiment, the locking retainer portion is wider than the locking portion.

18 Claims, 9 Drawing Sheets

(56) References Cited

U.S. PATENT DOCUMENTS

| | | | | |
|---|---|---|---|---|
| 2013/0106059 | A1* | 5/2013 | Larue | F41J 1/10 273/407 |
| 2013/0147118 | A1 | 6/2013 | Matthis | |
| 2014/0217674 | A1 | 8/2014 | Kochuba | |
| 2014/0284879 | A1 | 9/2014 | Hendrix | |
| 2015/0137455 | A1 | 5/2015 | Pixton | |
| 2016/0209184 | A1* | 7/2016 | Anderson | F41J 7/04 |
| 2017/0343324 | A1 | 11/2017 | Fernandez | |

* cited by examiner

MODULAR LOCKING TARGET LOCK AND LOCKING TARGET SYSTEM

PRIORITY CLAIM

This application is a continuation of and claims priority to and benefit of U.S. patent application Ser. No. 15/617,887, filed on Jun. 8, 2017 which is hereby incorporated by reference in its entirety.

BACKGROUND

1. Technical Field

This disclosure relates generally to a locking target device for steel targets and for an interlocking target system. More specifically, the target locking device allows various steel targets to be assembled and disassembled in a modular fashion. The target locking system allows a target face and a locking plate to be temporarily assembled during a shooting activity while maintaining a rigid connection capable of withstanding repeated projectile impacts.

2. Description of the Related Art

Targets are well-known devices used by shooters to hone their shooting abilities. Historically targets have been manufactured in many different ways including clay targets, live targets, paper targets, junk targets, bowling ball pins, trees, rocks, and many other implementations. One weakness of conventional targets is that they may be worn out by use. For example, a paper target may eventually contain so many holes from projectile impacts that it is virtually impossible to tell where a next projectile is impacting the target. In other implementations, for example, clay targets, once the target has been impacted by a projectile, the target is destroyed preventing further use. Thus, a common weakness of conventional targets is that these targets are effectively destroyed during their use. Further, when the targets are destroyed, the shooter must replace the targets or modify the targets such that it is necessary for a new target to be available to be shot at by the shooter.

One solution to this problem has been the use of self-sealing targets. Self-sealing targets are made using a plastic material which seals after being shot. After they have been created for example, when a shooter shoots a self-sealing target, the self-sealing target is damaged. The projectile makes a hole through the target. Once the hole exists, the plastic "melts," in a manner of speaking, back together to seal the hole made by the impact of the projectile. However self-sealing targets are typically worn out by extended use. As self-sealing targets are shot by projectile, small pieces of the self-sealing target are carried away from the target with the bullet. Over time this results in less material being available within the self-sealing target to seal bullet holes caused by a projectile impact. In this way, self-sealing targets are eventually worn out.

Another solution has been the use of steel targets. Steel targets may be fashioned from a heavy steel to light steel targets. Many of these steel targets are joined by welding or simply by nuts and bolts. In one embodiment, a rocking target, for example, may be bolted together. In another embodiment, a rocking target may be assembled by welding to permanently join one piece of the rocking target with another. One general weakness of steel targets are that they are generally heavy and difficult to transport. Further, steel targets provide generally less interaction than other types of targets and may become repetitive to a shooter thereby lessening interest in shooting that particular target.

Because steel targets are typically bolted or welded together, these targets present the same shooting situation to a shooter. These targets are typically not adjustable and do not allow shooter to change the shooting interface in any meaningful way. For example if a shooter has purchased a gong target, a target which is identified by the loud noise it makes when it is shot by projectile, the shooter may only shoot at the gong target. The gong target may swing because of a projectile impact or because of wind, making shooting the target unreasonably difficult and may require a shooter to wait until the target stops swinging after a projectile impact. The gong target essentially sits in the same place waiting to be shot over and over in a nonadjustable way. Since the noise made by the target is the interesting aspect of shooting a gong target, the gong target may be difficult to use over a period of time. In other words, it may be difficult for the shooter to maintain interest in shooting the gong target after the user has scored repeated strikes on the gong target.

In another example one category of steel targets is known as a dueling tree. A dueling tree provides paddles that rotate from side to side as they are shot by two different shooters. While there is substantial interaction between the shooters and the targets, the only functionality of the dueling tree is to allow the targets to rotate back and forth around the axis of the dueling tree as they are shot by the shooters. Essentially, the user is repetitively making the same shot over and over. Dueling trees provide little or no ability to adjust the targets or the manner in which the shooter interfaces with the targets.

It is therefore one object of this disclosure to provide a modular target locking device and a locking target system. It is a further object of this disclosure to provide a target that is both adjustable and capable of withstanding repeated strikes from a projectile. It is another object of this disclosure to provide a target locking system whereby a target and a locking plate may be connected together to form connection that is capable of withstanding repeated projectile impacts. Finally it is an object of this disclosure to provide a locking plate which allows a user to modify various targets to add interesting shooting opportunities to the shooting experience.

SUMMARY

Disclosed herein is a target system. The target system may include a locking plate having a first aperture and a second aperture. In one embodiment, the first aperture may be wider than the second aperture. The target system further includes a target face. The target face may be implemented with a target stem, a locking support, and a locking retainer. In one embodiment, the locking retainer may be wider than the second aperture.

Also disclosed herein is a target is which includes a locking plate. The locking plate includes a pass-through portion and a locking portion. In certain embodiments, the locking portion may be wider than the pass-through portion. The target system further includes a target face. The target face may be implemented with an elongated portion, a locking support portion, and a locking retainer portion. In one embodiment, the locking retainer portion is wider than the locking portion.

BRIEF DESCRIPTION OF THE DRAWINGS

The accompanying drawings illustrate an embodiment of a modular target locking device and a modular locking target system.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the subject matter disclosed herein. While the techniques and embodiments will primarily be described in context with the accompanying drawings, those skilled in the art will further appreciate the techniques and embodiments may also be practiced in other similar apparatuses.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
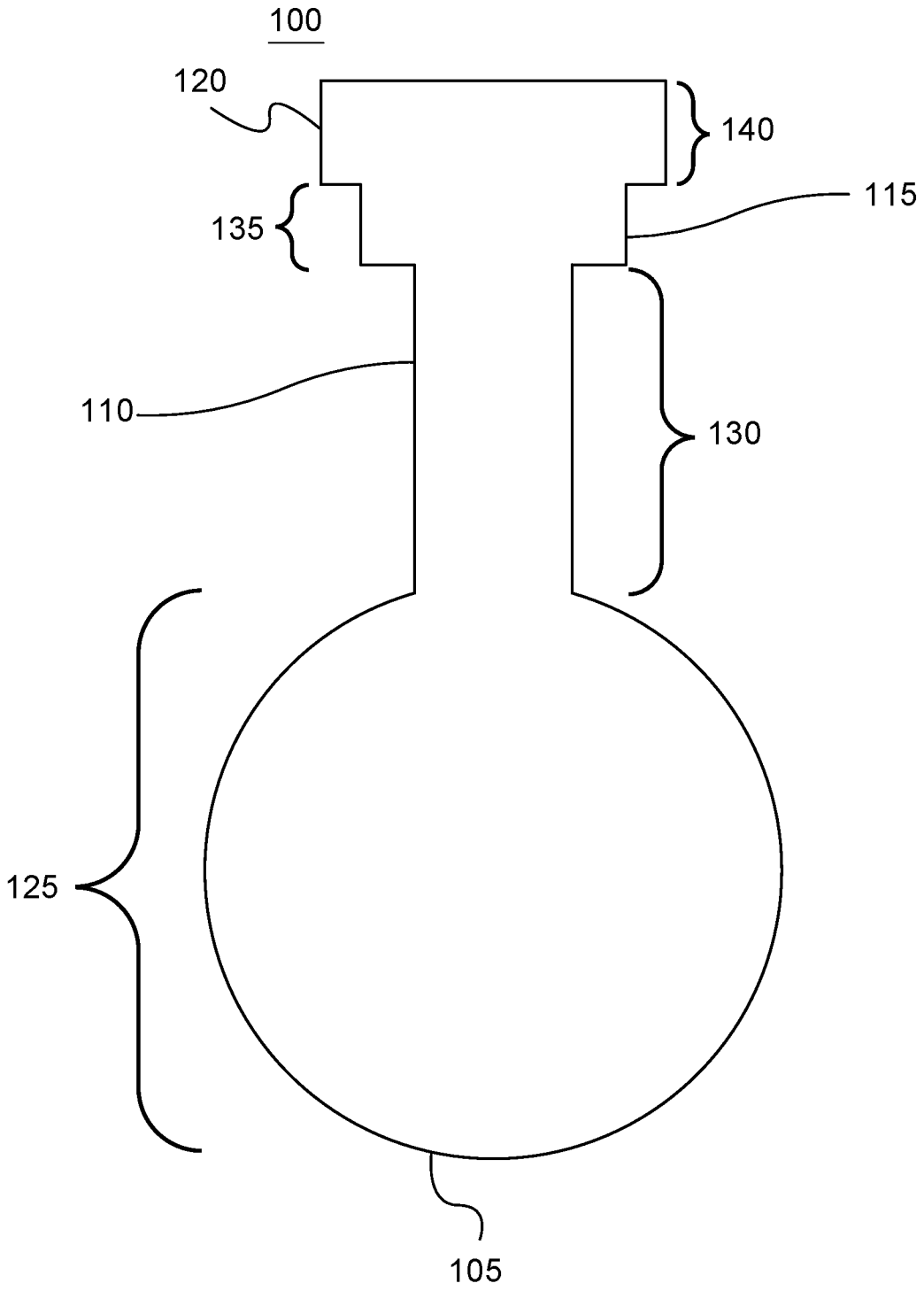
FIG. 1 illustrates a target face of the modular target locking device and modular locking target system.

FIG. 1 illustrates a target face 100. Target face 100 includes a target 105, a target stem 110, a locking support 115, and a locking retainer 120. Target face 100 may be constructed using hardened steel, such as AR-500 steel or other metals with a Brinell Hardness Value of between 450 and 550. However, it is conceived that other metals may be used such as titanium, aluminum, iron, other metal alloys, and bullet resistant plastics. Target face 100, target stem 110, locking support 115, and locking retainer 120 may be constructed from a single piece of hardened steel or other metals, as described above. Preferably however target face 100 is constructed using AR-500 steel with a Brinell Hardness Value of between 450 and 550. Target face 100 may, for convenience, also be referred to as comprising a number of portions. For example target 105 may also be referred to as target portion 125. Similarly target stem 110 may be referred to as elongated portion 130. Likewise locking support 115 may be referred to as locking support portion 135 and locking retainer 120 may be referred to as locking retainer portion 140.

As shown in FIG. 1 target 105 is implemented as a circular target. However, it is to be understood that a circular representation is shown in FIG. 1 is not necessary. Target 105 may be implemented in virtually any shape. For example, targets of the type standardized by shooting groups may be implemented in lieu of a circular target. For example target 105 may be implemented in the shape of a bowling pin. Alternatively, target 105 may be implemented as an IPSC target, a hostage target, or any other fanciful design. In some embodiments, target 105 may be implemented in the shape of fanciful creatures such as werewolves, vampires, stylized animals, animal silhouettes, human body silhouettes, zombie silhouettes, Frankenstein, or virtually any two-dimensional design. It is to also be noted that target 105 may be implemented as a substantially three-dimensional design. A three-dimensional design may be implemented as a sphere, pyramid, a human body shape, and animal shape, or virtually any other three-dimensional design.

Target 105 is integrally connected with target stem 110. Target stem 110 extends from locking support 115 and locking retainer 120 in one or more directions. It is to be noted that target stem 110, locking support 115, and locking retainer 120 are implemented with different widths. The term "width" as used herein intends to refer to a size of an element of target face 100 horizontally across target face 100 whereas the term "height" intends to refer to a size of an element of target face 100 vertically across a target face 100 according to the orientation shown in FIG. 1. The term "thickness" intends to refer to, for example, a thickness of the metal that makes up target face 100. As an example showing the intended interpretation of these terms, locking support 115 is wider than its height. Further, the height of locking support 115 is approximately equal to its thickness.

In one embodiment, target stem 110 may be the narrowest (least wide) portion of target face 100. Locking support 115 may be wider than target stem 110. Locking retainer 120 may be wider than both locking support 115 and target stem 110. In terms of height (or length), target stem 110 may be variable in height. The term "length" used here is interchangeable with the term "height" and refers to the distance between target 105 and locking support 115, comprising target stem 110. For example, target stem 110 may be long enough to extend target 105 away from a locking plate which will be discussed below.

Locking support 115 will typically, but may not, be as high as (as long as) the thickness of a locking plate while locking retainer 120 may be high/long enough to be easily grasped by a user. However, it is conceivable that locking retainer 120 may also extend upwards away from target 105 to create another target face (not shown). In this manner, target 105 may be provided and an additional target coupled to locking retainer 120 may be provided such that a shooter may have an option to shoot at two separate targets.

Figure 2:
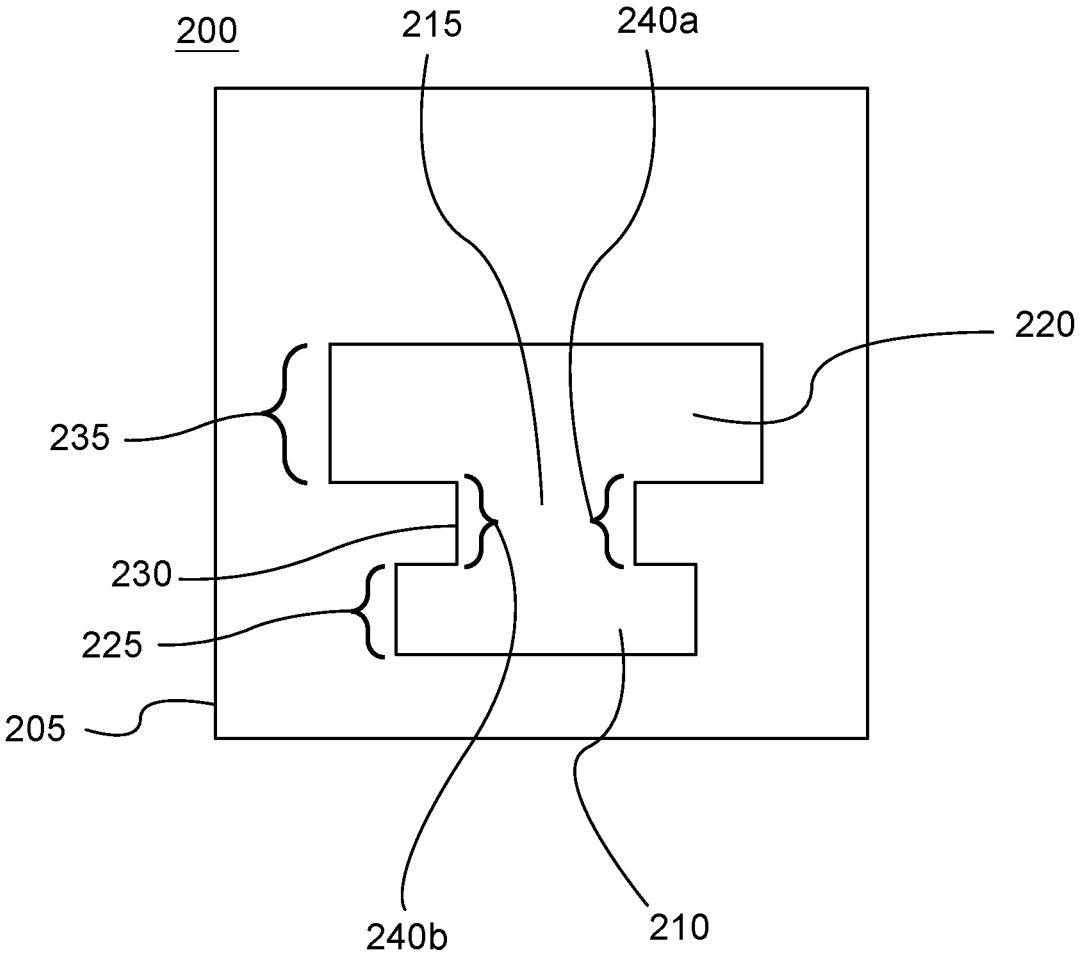
FIG. 2 illustrates a locking plate of the modular target locking device and modular locking target system.

FIG. 2 illustrates a target plate 200. Target plate 200 in a simple form may be implemented as a square or rectangular shape. Locking plate 200 includes plate 205. Plate 205 may be constructed using hardened steel, such as AR-500 steel or other metals with a Brinell Hardness Value of between 450 and 550. However, it is conceived that other metals may be used such as titanium, aluminum, iron, other metal alloys, and bullet resistant plastics.

Plate 205 includes a number of apertures. For example plate 205 includes locking aperture 210, pass-through aperture 215, and connecting aperture 220. It is also noted that for convenience and explanation that locking aperture 210 may be referred to as locking portion 225. Pass-through aperture 215 may be referred to as pass-through portion 230. Similarly connecting aperture 220 may be referred to as connecting portion 235. Plate 205 further includes a first tab 240*a* and a second tab 240*b* which define pass-through aperture 215.

Locking aperture 210, pass-through aperture 215, and connecting aperture 220 are disposed within plate 205 as having different respective widths. The term "width" as used herein intends to refer to a size of an aperture horizontally across a locking plate whereas the term "height" intends to refer to a size of an aperture vertically across a locking plate, according to the orientation shown in FIG. 2. The term "thickness" intends to refer to, for example, a thickness of the metal that makes up a locking plate. As an example showing the intended interpretation of these terms, locking aperture 210 is wider than its height. Further, the height of locking aperture 210 is approximately equal to its thickness.

Pass-through aperture 215 may be the narrowest (least wide) aperture, in terms of width, the distance between first tab 240*a* and second tab 240*b*. Locking aperture 210 may be wider than pass-through aperture 215. However, connecting aperture 220 may be wider than locking aperture 210. It is also to be noted, that the respective widths of locking aperture 210, pass-through aperture 215, and connecting aperture 220 correspond, respectively, to locking support 115, target stem 110, and locking retainer 120 of target face 100 shown in FIG. 1.

To be more specific, locking retainer 120, shown in FIG. 1, may pass through connecting aperture 220. Similarly locking support 115 and target stem 110, shown in FIG. 1, may also pass through connecting aperture 220 as locking support 115 and target stem 110 are less wide than locking retainer 120. Target stem 110, shown in FIG. 1, may pass through pass-through aperture 215. Thus target face 100, shown in FIG. 1, may pass through pass-through aperture 215 by ensuring that target stem 110 is disposed between tab 240*a* and tab 240*b* at the time target stem 110 passes through pass-through aperture 215. At this point, target face 100 may be dropped into locking aperture 210 such that locking support 115 fits snugly within locking aperture 210. Locking retainer 120 which is wider than locking support 115 may rest on plate 205 by inserting locking support 115 into locking aperture 210. This interlocking process will be discussed in more detail below.

Figure 3A:
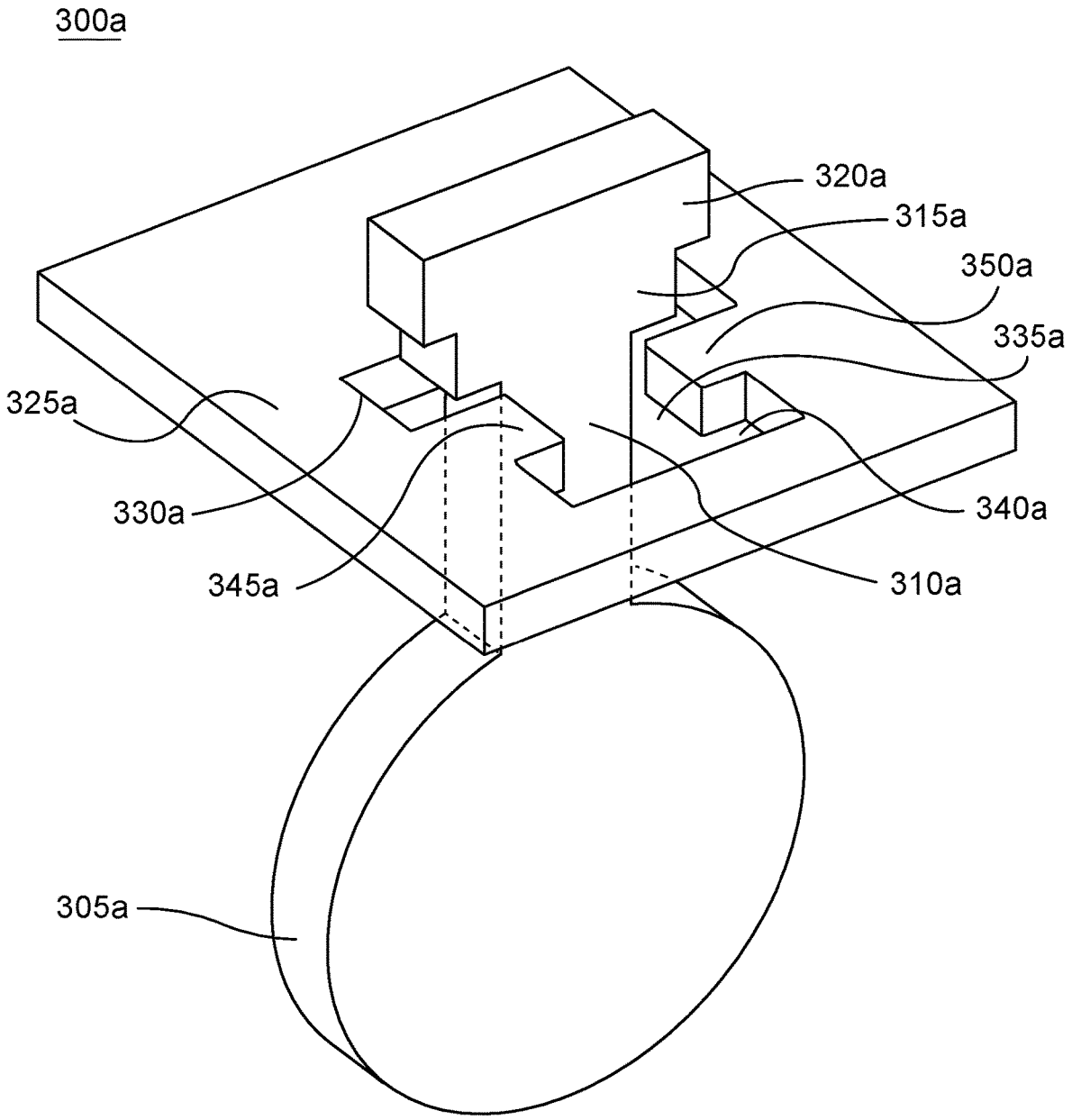
FIG. 3A illustrates a side perspective view of a first step of a method for interlocking the target face and the locking plate.

FIG. 3*a* illustrates a side perspective view of a first step of a method for interlocking a target face, such as target face 100 shown in FIG. 1, and a locking plate, such as locking plate 200, shown in FIG. 2. FIG. 3A includes a Target face 300*a*. Target face 300*a* comprises two separate pieces. First, a target portion is provided which includes target 305*a*, target stem 310*a*, locking support 315*a*, and locking retainer 320*a*. Second, target face 300*a* provides a plate 325*a*. Plate 325*a* includes a connecting aperture 330*a*, a pass-through aperture 335*a*, a locking aperture 340*a*, a first tab 345*a*, and a second tab 350*a*. As shown in FIG. 3A target face 300*a* may be selectively connected to provide a shooter with a target.

In this case, locking retainer 320*a* may be inserted through connecting aperture 330*a* from the underside of locking plate 320 (according to the orientation of locking plate 320 shown in FIG. 3A). It is to be noted that connecting aperture 330*a* may be wider and longer than locking retainer 320*a* so as to allow locking retainer 320*a* to be inserted through connecting aperture 330. As locking retainer 320*a* is inserted through plate 325*a*, locking support 315*a* will eventually rise above a topmost surface of locking plate 320*a*. Once locking support 315*a* has cleared the topmost surface of locking plate 325*a* the target portion may be moved into a locking position (i.e., moved forward according to the orientation of locking plate 325*a* shown in FIG. 3A) through pass-through aperture 335*a*, past tabs 345*a* and 350*a*, into locking aperture 340*a* as will be described below.

Figure 3B:
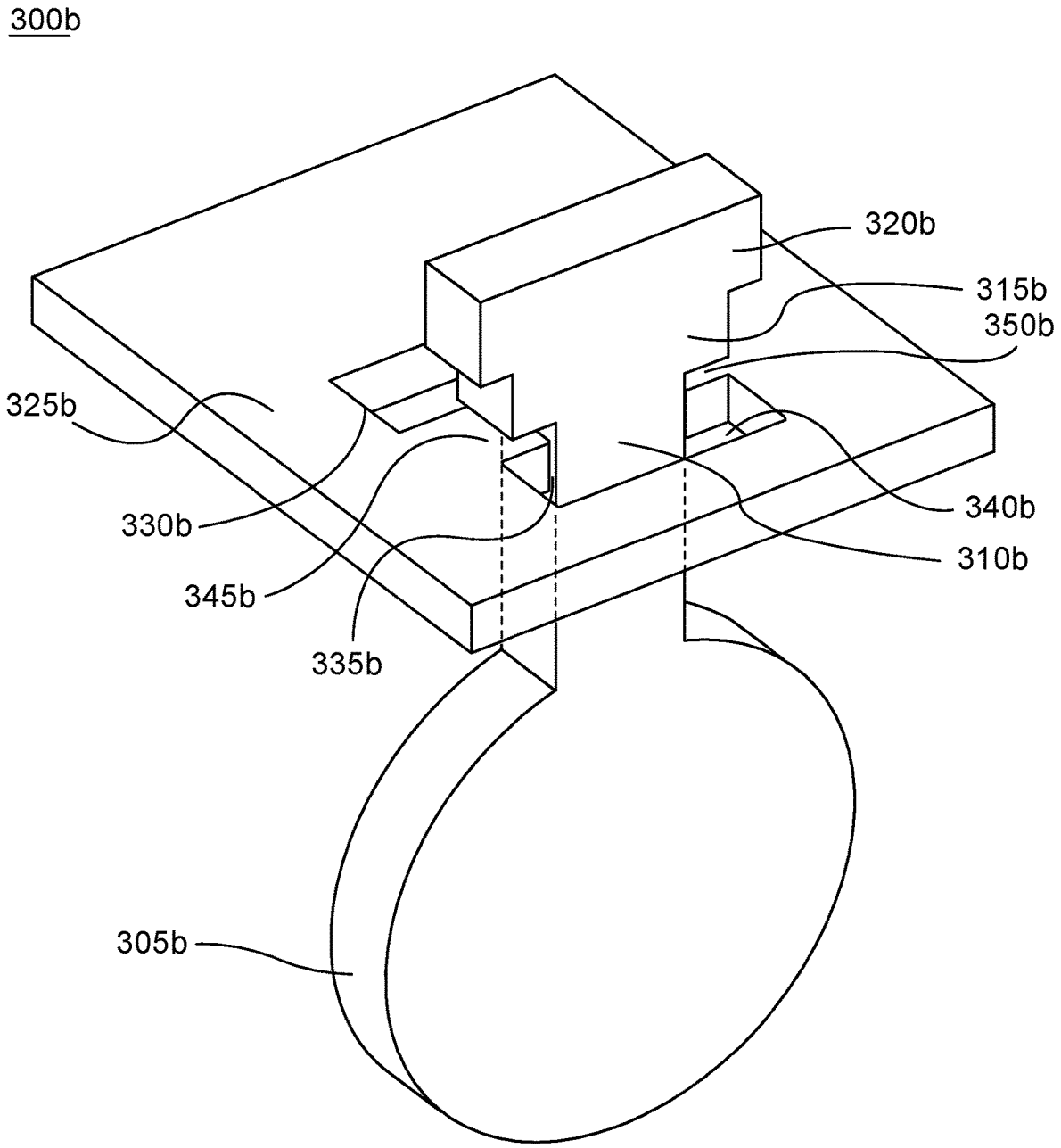
FIG. 3B illustrates a side perspective view of a second step of a method for interlocking the target face on the locking plate.

FIG. 3B illustrates a side perspective view of a second step of a method for interlocking a target face, such as target face 100 shown in FIG. 1, and a locking plate, such as locking plate 200, shown in FIG. 2. FIG. 3B continues from FIG. 3A. FIG. 3B also illustrates a target face 300*b* which includes two separate pieces. First, target face 300*b* provides a target portion which includes target face 305*a* target stem 310*b*, locking support 315*b*, and locking retainer 320*b*. Second, target face 300*b* provides a plate 325*b*. Plate 325*b* includes a connecting aperture 330*b*, a pass-through aperture 335, a locking aperture 340*b*, a first tab 345*b*, and a second tab 350*b*.

As shown in FIG. 3B, locking retainer 320*b* has been inserted through connecting aperture 330*b* (as discussed above with respect to FIG. 3A) to an extent that the target portion may be moved forward into pass through aperture 335*b*, past first tab 345*b* and second tab 350*b*, by aligning target stem 310*b* with pass through aperture 335*b*. Pass-through aperture 335*b* is the narrowest aperture when compared with connecting aperture 330*b* and locking aperture 340*b*. In this manner, the target portion of target 300*b* may only pass through pass-through aperture 335*b* when locking retainer 320*b* has been inserted through connecting aperture 330*b* to a point where target stem 310*b* may line up with and pass through pass-through aperture 335*b*. Thus, the target portion may be moved forward within plate 325*b* into pass-through aperture 335*b*.

Figure 3C:
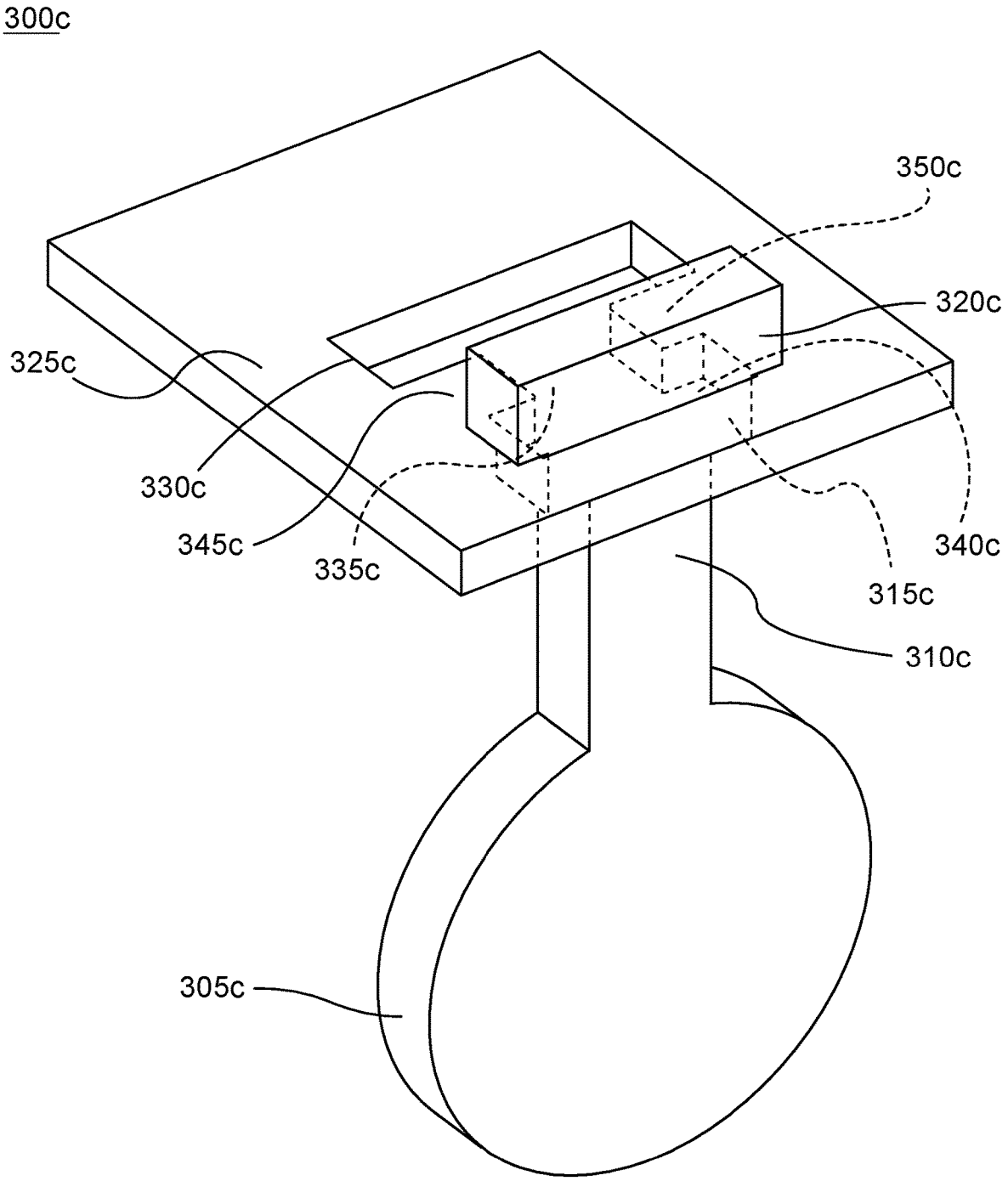
FIG. 3C illustrates a side perspective view of a third step of a method for interlocking the target face on the locking plate.

FIG. 3C illustrates a side perspective view of a third step of a method for interlocking a target face, such as target face 100 shown in FIG. 1, and a locking plate, such as locking plate 200, shown in FIG. 2. FIG. 3C continues from FIG. 3B. FIG. 3C also illustrates a target face 300*c* which includes two separate pieces. First, target face 300*c* provides a target portion which includes target face 305*c*, target stem 310*c*, locking support 315*c*, and locking retainer 320C. Second, target face 300*c* provides a plate 325*c*. Plate 325*c* includes a connecting aperture 330*c*, a pass-through aperture 335*c*, a locking aperture 340*c*, a first tab 345*c*, and a second tab 350*c*.

As shown in FIG. 3C, locking retainer 320*c* has been moved forward, relative to FIG. 3B and released into locking aperture 340*c*. Locking aperture 340*c* may be narrower than connecting aperture 330*b*. At the same time, however, locking aperture 340*c* may be wider than pass-through aperture 335*c*. In one implementation, locking support 315*c* may enjoy substantially complimentary dimensions as locking aperture 340*c* such that the target portion fits snugly within locking aperture 340*c*. For example, when locking support 315*c* has approximately the same dimensions in both width and length as locking aperture 340*c*, the target portion may be firmly connected to target plate 325*c*. First tab 345*c* and second tab 350*c* may ensure that the target portion remains firmly in place. Further, since locking retainer 320*c* is wider than locking aperture 340*c*, locking retainer 320*c* rests on a topmost surface of plate 325*b* and is secured in place by gravity.

In this manner, when target face 305*c* is struck by a projectile fired by a firearm, or any other device, pressure from the impact of the strike is transferred into first tab 345*c* and second tab 350*c*. Because first tab 345*c* and second tab 350*c* are constructed using AR-500 steel with a Brinell Hardness Value between 450 and 550, first tab 345*c* and second tab 350*c* have sufficient strength to absorb the pressure from the impact of the strike without deforming or bending regardless of the impact pressure applied to target 305*ac* by a projectile fired by a firearm, or other device. Tests have shown no deformation to first tab 345*c* and second tab 350*c* from impacts from projectiles fired by firearms up to a 50 caliber Browning Machine Gun round (50 BMG). Accordingly, target 300*c* is remarkably resilient to small arms fire as well as simple to set up, take down, and use.

Figure 4A:
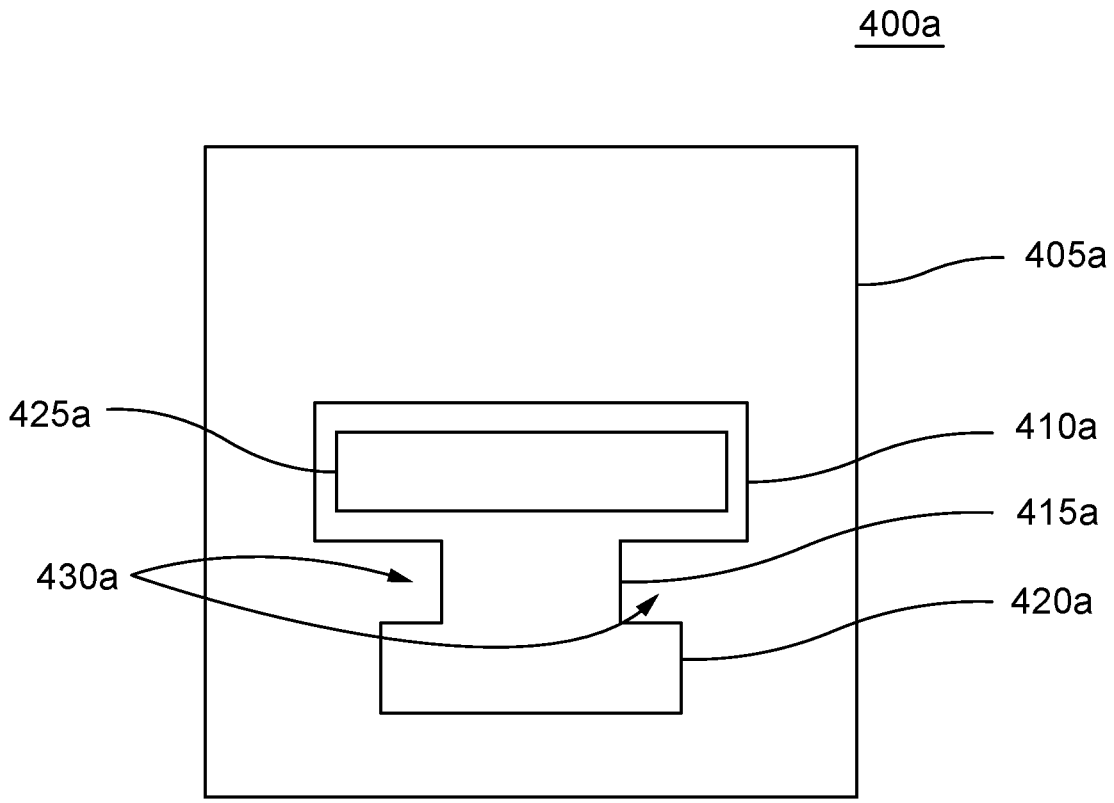
FIG. 4A illustrates a top view of a first step of a method for interlocking the target face and the locking plate.

FIG. 4A illustrates a top view of a first step of a method for interlocking target 400*a*, such as target face 100 shown in FIG. 1, and a locking plate, such as locking plate 200, shown in FIG. 2. FIG. 4A corresponds to FIG. 3A. As shown in FIG. 4A, target 400*a* includes a locking plate 405*a*. Locking plate includes a plurality of interconnected apertures, referred to as connecting aperture 410*a*, pass-through aperture 415*a*, and locking aperture 420*a*. Target 400*a* also includes a target face represented in this view by locking retainer 425*a*.

As shown in FIG. 4A, these interconnected apertures have varying dimensions, relative to each other. For example, connecting aperture 410*a* is wider than locking retainer 425*a* to allow locking retainer 425*a* to be insertable through connecting aperture 410*a*. Pass-through aperture 415*a* is less wide than connecting aperture 410*a* and locking aperture 420*a* where the width of pass-through aperture 415*a* is defined by the distance between tabs 430*a*. Locking aperture 420*a* is approximately as wide as a locking support, such as locking support 115, shown in FIG. 1, and less wide than locking retainer 120, shown in FIG. 1. Further, locking aperture 420*a* is wider than pass-through aperture 420*a* but less wide than connecting aperture 410*a*. In FIG. 4A, locking retainer 425*a* may be inserted through connecting aperture 410*a* up to a point even with an elongated portion of target 400*a*, such as elongated portion 130 of target 100 shown in FIG. 1.

Figure 4B:
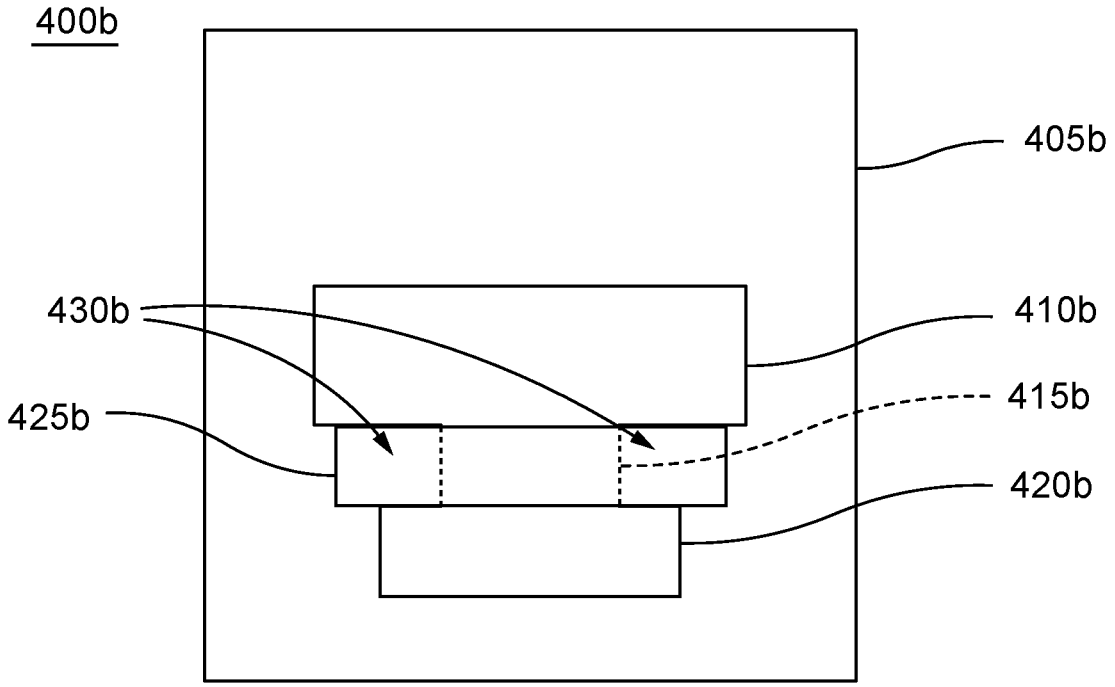
FIG. 4B illustrates a top view of a second step of a method for interlocking the target face on the locking plate.

FIG. 4B illustrates a top view of a second step of a method for interlocking target 400*b*, such as target face 100 shown in FIG. 1, and a locking plate, such as locking plate 200, shown in FIG. 2. FIG. 4B corresponds to FIG. 3B. As shown in FIG. 4B, target 400*b* includes a locking plate 405*b*. Locking plate includes a plurality of interconnected apertures, referred to as connecting aperture 410*b*, pass-through aperture 415*b*, and locking aperture 420*b*. Target 400*b* also includes a target face represented in this view by locking retainer 425*b*.

In FIG. 4B, locking retainer 425*b* has been inserted through connecting aperture 410*b* (as discussed above with respect to FIG. 4A) to an extent that the locking retainer 425*b*, representing target 100, shown in FIG. 1, may be moved forward into pass through aperture 415*b*, past tabs 430*b*, by aligning an elongated portion of the target, such as elongated portion 130 of target 100, with pass through aperture 415*b*. Pass-through aperture 415*b* is the narrowest aperture, in terms of width, when compared with connecting aperture 410*b* and locking aperture 420*b*. In this manner, the target portion of target 400*b* may only pass through pass-through aperture 415*b* when locking retainer 425*b* has been inserted through connecting aperture 410*b* to a point where the elongated portion of the target, such as elongated portion 130 of target 100, may line up with and pass through pass-through aperture 415*b*. Thus, the target portion may be moved forward within plate 405*b* into pass-through aperture 415*b*.

Figure 4C:
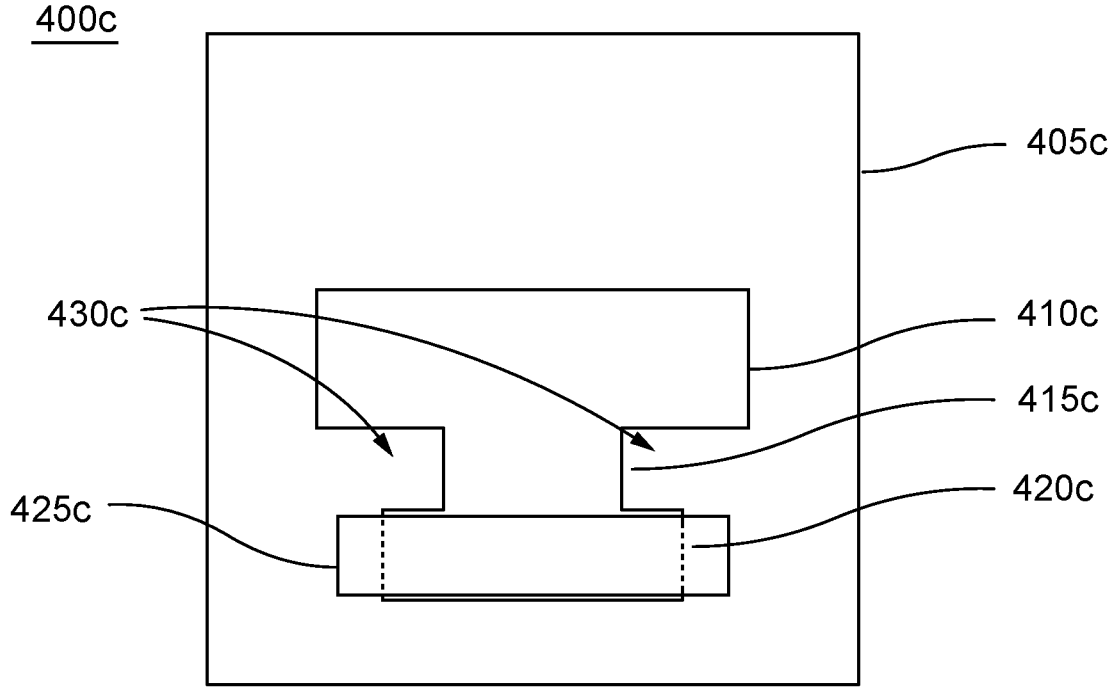
FIG. 4C illustrates a top view of a third step of a method for interlocking the target face on the locking plate.

FIG. 4C illustrates a top view of a third step of a method for interlocking target 400*c*, such as target face 100 shown in FIG. 1, and a locking plate, such as locking plate 200, shown in FIG. 2. FIG. 4C corresponds to FIG. 3C. As shown in FIG. 4C, target 400*c* includes a locking plate 405*c*. Locking plate includes a plurality of interconnected apertures, referred to as connecting aperture 410*c*, pass-through aperture 415*c*, and locking aperture 420*c*. Target 400*c* also includes a target face represented in this view by locking retainer 425*c*.

As shown in FIG. 4C, locking retainer 425*c* has been moved forward, relative to FIG. 4B and released into locking aperture 420*c*. Locking aperture 420*c* may be narrower than connecting aperture 410*c*. At the same time, however, locking aperture 420*c* may be wider than pass-through aperture 415*c*. In one implementation, a locking support connected to locking retainer 425*c*, such as locking support 115 shown in FIG. 1, may enjoy complimentary dimensions with locking aperture 420*c* such that a locking support fits snugly within locking aperture 420*c*. For example, when the locking support has approximately the same dimensions in both width and height as locking aperture 420*c*, the target portion may be firmly connected to target plate 405*c*. Tabs 430*c* may ensure that the target portion remains firmly in place. Further, since locking retainer 425*c* is wider than locking aperture 420*c*, locking retainer 425*c* rests on a top most surface of plate 405*c* and is secured in place by gravity.

In this manner, when target 400*c* is struck by a projectile fired by a firearm, pressure from the impact of the strike is transferred into tabs 430*c*. Because tabs 430*c* are constructed using AR-500 steel with a Brinell Hardness Value between 450 and 550, tabs 430*c* have sufficient strength to absorb the pressure from the impact of the strike without deforming or bending regardless of the impact pressure applied to target 400*c* by a projectile fired by a firearm. Tests have shown no deformation to tabs 430*c* from impacts from projectiles fired by firearms up to a 50 caliber Browning Machine Gun round (50 BMG). Accordingly, target 400*c* is remarkably resilient to small arms fire as well as simple to set up, take down, and use.

Figure 5:
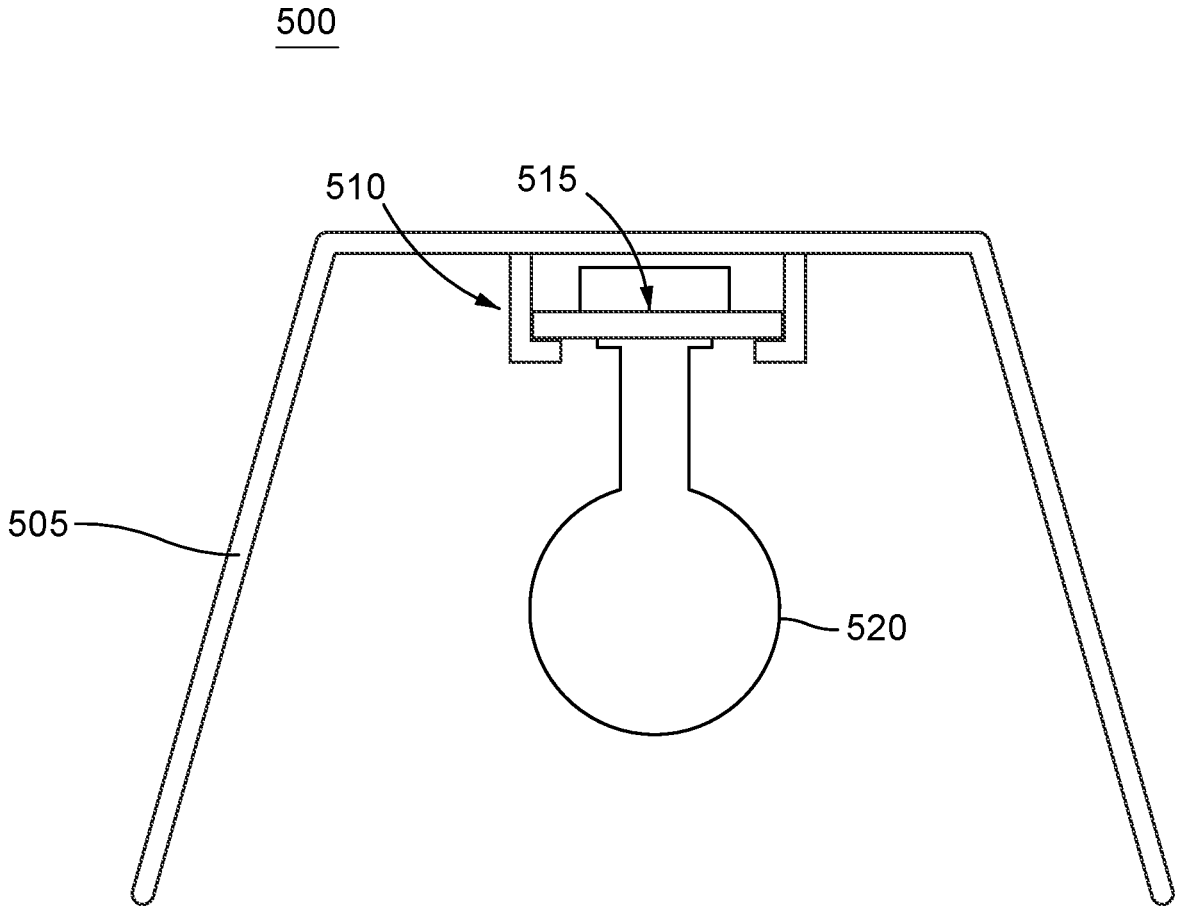
FIG. 5 illustrates a gong style target that implements a modular target locking device and a modular target locking system.

FIG. 5 illustrates a gong style target 500 that implements a modular target locking device and a modular target locking system. The modular target locking device and a modular locking target system may be implemented using a variety of different mechanisms. For purposes of explanation, a gong style target 500 provides a simple example. Gong style target 500 may include a stand 505 that may itself be modular and easy to assemble. For example, stand 505 may be implemented with a locking plate on downward legs and a locking retainer on opposite sides of a cross piece, or vice versa. In one alternative example, a cross piece and a downward leg may be connected in a fashion that is similar to that described herein. That is to say, a cross piece may include a locking retainer portion, a locking support portion, and an elongated portion, such as locking retainer portion 140, a locking support portion 135, and an elongated portion 130 shown in FIG. 1. Similarly, a downward leg may include a connecting portion, a pass through portion, and a locking portion, such as connecting portion 235, pass-through portion 230, and locking portion 225, shown in FIG. 2. A cross piece and downward legs may be connected using the techniques shown and described with respect to FIGS. 3A-3C and FIGS. 4A-4C.

In FIG. 5, mount 510 is provided to secure locking plate 515 to a cross piece of stand 505. Mount 510 is shown as prongs which are attached to locking plate 515. However, mount 510 is merely representative of many alternative connections of locking plate 515 to the cross piece of stand 505. It is also conceivable that locking plate 515 may simply be welded to a cross piece of stand 505. It is also conceivable that the cross piece of stand 505 may include a plurality of mounts, each providing another connection point for an additional target 520. Any number of targets may be implemented by connecting a locking plate to a stand 505 providing the shooter with some degree of variety of targets at which to shoot.

As shown in FIG. 5, target 520 is installed within locking plate 515 in a manner similar to that shown and described with respect to FIG. 3C and FIG. 4C, above. In this manner, stand 505 may be erected in a safe place and provide a durable target solution for shooters shooting any type of firearm. One additional advantage is that gong style target 500 provides the well-loved "gong" sound when it is struck by a projectile fired by a firearm providing a clear reaction to a strike and ensuring that the shooter can hear that a strike was achieved. Similarly, an additional advantage is that when target 520 is struck by a projectile or blown by wind, target 520 does not move or swing in the way conventional gong targets do. This allows a shooter to make quick repetitive shots without waiting for the target to stop swinging, providing for a unique training scenario and additional challenge.

Figure 6:
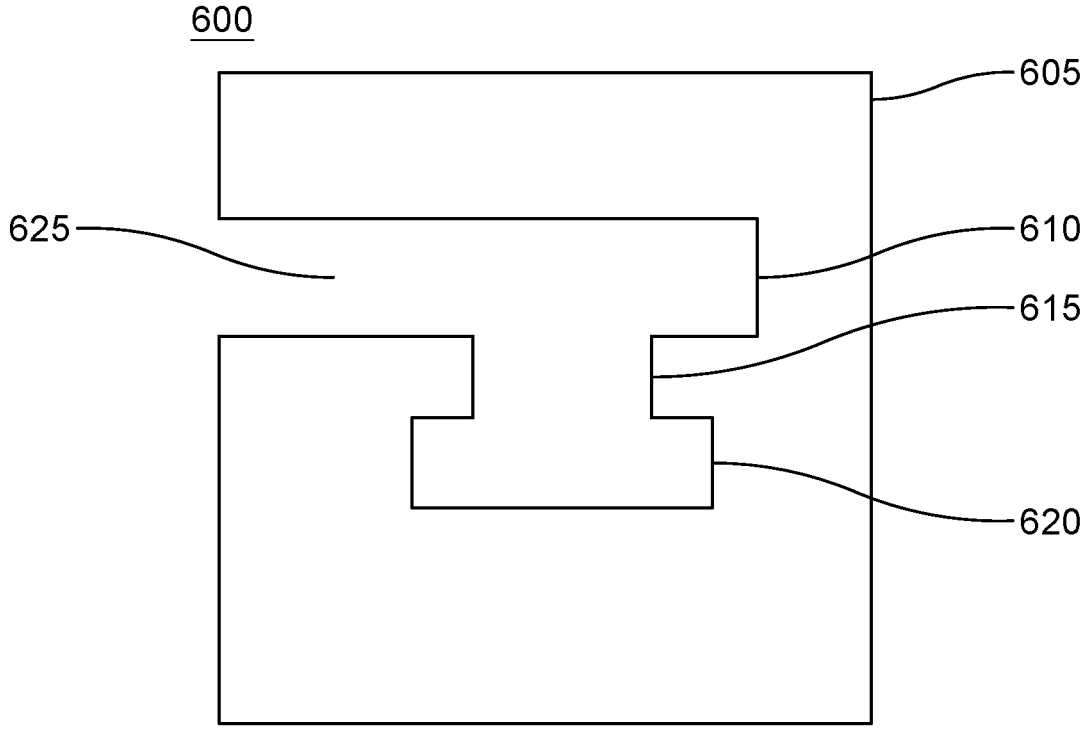
FIG. 6 illustrates an alternative locking plate.

FIG. 6 illustrates an alternative target plate 600 to target plate 200, shown in FIG. 2. In FIG. 6, plate 605 is provided using materials and construction similar to those described above with respect to target plate 200, shown in FIG. 2 and described above. Plate 605 includes a connecting aperture 610, a pass-through aperture 615, and a locking aperture 620. However, connecting aperture includes an opening 625 in plate 605 whereby target face 100, shown in FIG. 1, may be installed from a side of plate 605 through opening 625, instead of being inserted through connecting aperture 610, as previously disclosed. In this fashion, a locking plate 605 may be installed in situations where target plate 200, shown in FIG. 2 for example, may be more difficult to install or use.

Figure 7:
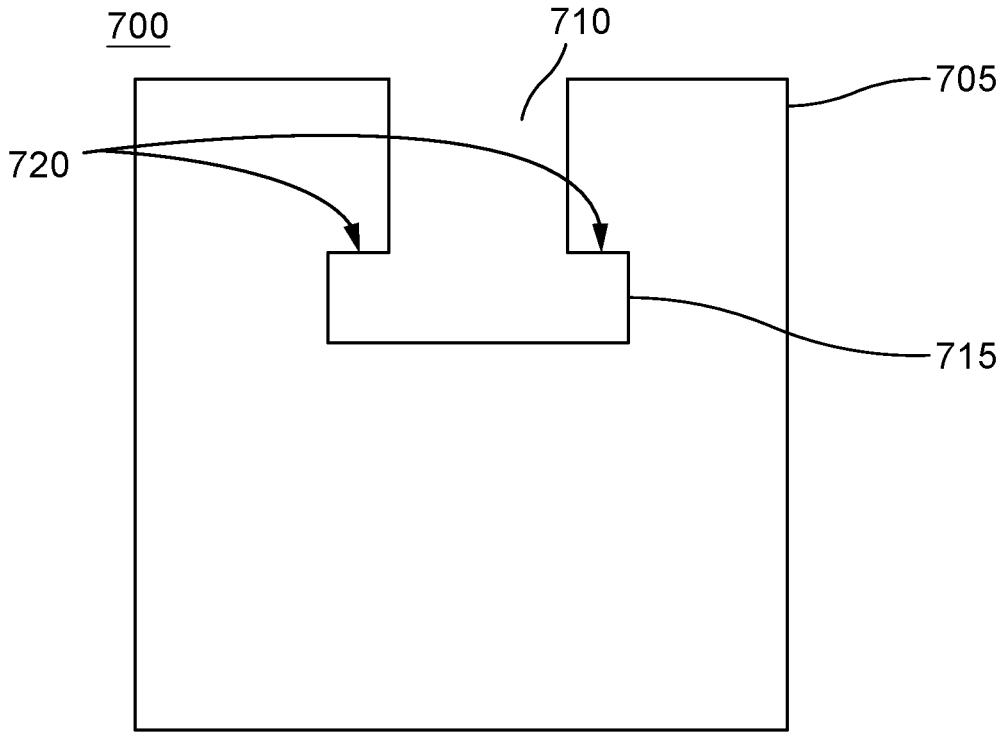
FIG. 7 illustrates another alternative locking plate.

FIG. 7 illustrates another alternative locking plate 700 which is an alternative to target plate 600, shown in FIG. 6 and target plate 200, shown in FIG. 2. In FIG. 7, plate 705 is provided using materials and construction similar to those described above with respect to target plate 200, shown in FIG. 2 and described above. Plate 705 includes a pass-through aperture 710 and a locking aperture 715. Instead of providing an additional aperture for connecting a target face, such as target face 100 shown in FIG. 1, target face 100 may be installed by simply starting by aligning an elongated portion 130 of target face 100 shown in FIG. 1, for example, with pass through portion 710 of plate 705 as shown in FIG. 3B and FIG. 4B and described above. In FIG. 7, surfaces 720 serve as tabs securely locking target face 100 in place in a manner similar to that shown in FIG. 3C and FIG. 4C and described above. Thus, plate 705 may be installed in situations where target plate 200, shown in FIG. 2 for example, may be more difficult to install or use.

It is to be further noted that other implementations of the foregoing subject matter are possible without departing from the scope or spirit of the embodiments disclosed herein. For example, instead of target plate 200 including substantially rectangular apertures, target plate 200 may be constructed using other three dimensional geometric and non-geometric shapes. For one non-limiting example, connecting aperture 230 may be implemented as a triangular aperture and locking aperture 210 may be implemented as a smaller triangular aperture, relative to the larger triangular aperture. Likewise, target stem 110, locking support 115, and locking retainer 120 of target face 100 shown in FIG. 1 may be implemented in a complimentary geometric shape to the shape used on target plate 200. In some embodiments, target stem 110 may be "keyed" such that target stem 110 may pass from a first geometric aperture to another geometric aperture through a pass-through aperture at a specific spot along target stem 110. The geometric shape chosen for target plate 200 and target face 100 may be tapered above a target 105 to correspond to and interlock using the techniques described herein. Possible geometric shapes include polygons (triangles, squares/rectangles, pentagons, hexagons . . . etc.), circles, spheres, ovals, oblong shapes, non-symmetrical shapes, and any other shape. However, the specific shape chosen for implementation as an aperture in target plate 200 or in target face 100 is secondary to providing apertures with a ratio of sizes such that a first aperture or opening in or on target plate 200 is large enough to allow target face 100 to be connected, a second aperture or opening on target plate 200 allows target face 100 to move through the second aperture, and a third aperture or opening on target plate 200 allows target face 100 to interlock with target plate 200. The ratio of sizes referred to above means that the first aperture or opening in or on target plate 200 is larger than the second aperture or the third aperture. Similarly, the third aperture is larger than the second aperture but smaller than the first aperture. The second aperture is the smallest aperture in terms of size, regardless of how the first, second, and third aperture are implemented, whether in a three dimensional geometric shape or using substantially flat steel as shown herein.

The foregoing description is presented for purposes of illustration. It is not exhaustive and does not limit the invention to the precise forms or embodiments disclosed. Modifications and adaptations are apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A target system, comprising:

a locking plate having a first aperture and a second aperture, where the first aperture is wider than the second aperture; and a target face having a target stem, a locking support, and a locking retainer, where the locking retainer is wider than the first aperture and is wider than the locking support.

2. The target system of claim 1, wherein the locking plate includes a third aperture.

3. The target system of claim 2, wherein the third aperture is wider than the first aperture and the locking retainer.

4. The target system of claim 1, wherein the locking plate is constructed from steel with a Brinell Hardness Value between 450 and 550.

5. The target system of claim 1, wherein the first aperture is defined by a first tab and a second tab disposed within the locking plate.

6. The target system of claim 1, wherein the target face includes a target.

7. The target system of claim 1, wherein the locking support is wider than the target stem.

8. The target system of claim 1, wherein the dimensions of the second aperture allow the target stem to pass through the second aperture.

9. The target system of claim 1, wherein the target face is constructed from steel with a Brinell Hardness Value between 450 and 550.

10. A target system, comprising:

a locking plate including a first aperture having a first width and a second aperture having a second width, wherein the first aperture is wider than the second aperture and the first aperture connects to the second aperture, wherein the second aperture is accessible in the locking plate through an opening in an exterior edge of the locking plate, wherein the second aperture is perpendicular to the edge of the locking plate which contains the opening; and wherein the locking support is wider than the target stem and the locking retainer is wider than the locking support.

11. The target system of claim 10, further comprising a third aperture having a third width that is wider than both the first width and second width.

12. The target system of claim 11, wherein the third aperture connects to an opening in an edge of the locking plate.

13. The target system of claim 12, wherein the third aperture is perpendicular to the edge of the locking plate which contains the opening.

14. The target system of claim 10, wherein the locking plate is constructed from steel with a Brinell Hardness value exceeding 450.

15. The target system of claim 10, further comprising a target face, the target face including a target stem, a locking support, and a locking retainer.

16. The target system of claim 15, wherein the target face includes a target.

17. The target system of claim 15, wherein the target face is constructed from steel with a Brinell Hardness Value between 450 and 550.

18. The target system of claim 15, wherein the dimensions of the second aperture allow the target stem to pass through the second aperture.

* * * * *